United States Patent [19]

McNeer

[11] Patent Number: 4,522,264

[45] Date of Patent: Jun. 11, 1985

[54] APPARATUS AND METHOD FOR TREATING WELLS

[75] Inventor: Johnny C. McNeer, Lake Charles, La.

[73] Assignee: Otis Engineering Corporation, Dallas, Tex.

[21] Appl. No.: 529,165

[22] Filed: Sep. 2, 1983

[51] Int. Cl.[3] ..... E21B 43/04; E21B 43/10

[52] U.S. Cl. ..... 166/278; 166/51; 166/131; 166/151

[58] Field of Search ..... 166/51, 276, 278, 143, 166/144, 149, 151, 158, 181, 188, 125, 129, 133, 131

[56] References Cited

U.S. PATENT DOCUMENTS

| | | | |
|---|---|---|---|
| 3,627,046 | 12/1971 | Miller et al. | 166/278 |
| 3,710,862 | 1/1973 | Young et al. | 166/278 |
| 3,999,608 | 12/1976 | Smith | 166/278 |
| 4,180,132 | 12/1979 | Young | 166/120 |
| 4,253,522 | 3/1981 | Setterberg, Jr. | 166/51 |
| 4,372,384 | 2/1983 | Kinney | 166/278 |

*Primary Examiner*—Stephen J. Novosad
*Assistant Examiner*—William P. Neuder
*Attorney, Agent, or Firm*—Albert W. Carroll

[57] ABSTRACT

Improved apparatus for packing particulates such as sand, gravel, or the like, around a well screen in a well for sand control, the apparatus having provisions for packing the particulates tightly in place without relying on settling due to gravity, thus requiring minimal distance between the packer and the casing perforations. Methods of performing such packing operations are also disclosed.

22 Claims, 9 Drawing Figures

APPARATUS AND METHOD FOR TREATING WELLS

BACKGROUND OF THE INVENTION

1. Field of the Invention

This invention relates to wells and well tools. More particularly it relates to apparatus for and methods of treating wells as by packing particulate material such as sand or gravel in the area of the production zone for purposes of sand control.

2. Description of the Prior Art

It is common sand-control practice in the oil and gas industry to install a screen in a well on a level with the producing formation and then pack particulates such as sand or gravel or the like around the screen, in the perforations and in any cracks and/or crevices connected therewith. These particulates are packed tightly and serve to brace or support the producing earth formation laterally to hold it in its natural place and thus keep formation sand and the like out of the well bore while allowing production fluids to enter the well bore and flow to the surface in the well-known manner.

It is also common to introduce the sand or the like particulate material into the well in the form of a slurry in which the individual grains are suspended in a gel, that is, in a gelatinous or viscous medium, to maintain these grains separated. This gelatinous substance coats each grain to lubricate it and enable it to flow more readily from the surface to the place of deposit downhole in the well and to protect it against fragmentation as a result of impacting with other grains during the trip. Ideally, after the sand is deposited around a well screen, it is "dehydrated" by applying a pressure thereto to squeeze the gelatinous substance out of it and cause the sand grains to move compactly into place to provide adequate support for the earth formation.

One of the problems encountered in such packing operations has been the inability to efficiently dehydrate the sand around and, in particular, above the screen. Thus, a substantial portion of the sand was necessarily left to settle by gravity, and for this much space was needed since 100 feet of gelatin coated sand may settle to less than 30 percent of that height.

In packing particulate material about a screen, the apparatus used includes a well packer with a screen attached to its lower end, a pipe string, and a service seal unit connected between the pipe string and the packer. The service seal unit is used in setting the packer and in directing the flow of fluids through the packer and screen to assure that the particulate material is deposited around the screen and that the excess particulate material is thereafter cleared from the well. Manipulation of the pipe string has been used to move at least a part of the service seal unit relative to the packer each time that it was necessary to change the flow pattern through the packing apparatus.

It is desirable to minimize manipulation of the pipe string in gravel pack type operations and thus reduce to a minimum the number of steps involved in the methods used. It is highly desirable to pack the sand or particulate material tightly about the well screen and in the perforations and other openings or cracks adjacent thereto so that the producing formation will be propped in place outside the casing and will remain there while production fluids freely flow from the formation through the casing perforations and into the well, then upward to the surface. It is desirable to minimize the distance between the screen and the packer and to minimize the time and costs of gravel-packing type operations.

Known prior art which relates to this present invention includes:

(a) U.S. Pat. No. 3,710,862;

(b) U.S. Pat. No. 4,180,132;

(c) U.S. patent application Ser. No. 06/493,147, now U.S. Pat. No. 4,519,451; and (d) Brochure No. OEC-5147 entitled "OTIS SINGLE-ZONE SAND-CONTROL SYSTEM" published by Otis Engineering Corporation, Dallas, Tex.

U.S. Pat. No. 3,710,862 issued Jan. 16, 1973 to Carter R. Young, et al, for METHOD AND APPARATUS FOR TREATING AND PREPARING WELLS FOR PRODUCTION. This patent discloses apparatus and methods for gravel packing a well.

U.S. Pat. No. 4,180,132 issued to Carter R. Young on Dec. 25, 1979 for SERVICE SEAL UNIT FOR WELL PACKER. This patent discloses a service seal unit for use in gravel packing apparatus and methods similar to those disclosed in U.S. Pat. No. 3,710,862, but it includes means actuable by hydraulic pressure for setting the packer and means associated therewith for preventing premature setting of the packer.

Patent application Ser. No. 06/493,147 was filed May 9, 1983 by Floyd R. Gray and Dennis D. Rood for WELL TREATING EQUIPMENT AND METHODS. This patent application discloses well gravel packing apparatus and methods which are improvements over the apparatus and methods taught in U.S. Pat. Nos. 3,710,862 and 4,180,132, just mentioned.

Brochure OEC-5147 entitled "OTIS SINGLE-ZONE SAND-CONTROL SYSTEM, published by Otis Engineering Corporation, Dallas, Tex., discloses well gravel packing apparatus and methods similar to those provided by the present invention.

None of the prior art of which applicant is aware shows or teaches methods of or apparatus for gravel packing wells and utilizing a normally closed lateral opening in the service seal unit which will open automatically when the sand or the like becomes packed or dehydrated around the screen to short-circuit the fluid flow path to permit further circulation of sand-laden fluids, packing, and dehydration without having to rely on gravitational settling of the sand or the like in the annulus, which requires excessive, expensive longitudinal space between the packer and the screen.

The prior art patents, U.S. Pat. Nos. 3,710,862 and 4,180,132 and U.S. patent application, Ser. No. 06/493,147, all mentioned hereinabove, are incorporated herein for all purposes by reference thereto.

SUMMARY OF THE INVENTION

This invention is directed to well treating equipment and methods wherein the apparatus includes a well packer having a well screen attached thereto with lateral openings therebetween, and a service seal unit tool connecting the packer and to a pipe string, the service seal unit tool having a tubular body telescoped into the packer bore and having seals sealing above and below the lateral openings of the packer, the service seal unit body having lateral port means between its seals communicating with the lateral openings of the packer, the service seal unit having a tubular wash pipe extending through the body and having its lower end opening into the lower portion of the screen and its upper end opening into the well annulus above the packer, there being annular seal means in the screen sealing about the lower end of the wash pipe, the wash pipe having an initially closed lateral passage above the just mentioned annular seal which opens automatically to short-circuit the fluid circulation path through the apparatus when the pressure exterior of the lateral passage exceeds the pressure within the wash pipe by a predetermined amount.

The methods are directed to attaching a well packer to a well screen with lateral openings therebetween, attaching a service seal unit to the packer and to a pipe string, lowering the pipe string into the well, setting the packer above the casing perforations, circulating treating fluids laden with sand or the like down the pipe string and through the packer and lateral openings to the exterior of the screen, through the screen and upward through the packer to the surface, leaving the sand or the like deposited about the screen, increasing the pressure in the screen exterior of the wash pipe to open the lateral passage to short-circuit the circulation flow path, circulating additional fluids laden with sand or the like through the shorted circuit to build up the particulate deposit about the screen, then lifting the service seal unit tool relative to the packer and circulating cleanout fluids downward through the well annulus and through the lateral ports of the service seal unit tool, then upward through the pipe string to the surface to remove the excess treating fluid from the well.

It is therefore one object of this invention to provide improved apparatus for packing particulate material such as sand or the like around a well screen in a well to exclude formation sand or the like from the well bore.

Another object is to provide apparatus such as that described having provisions therein for short-circuiting a fluid circulation flow path therethrough to aid in effecting an improved pack of particulates around the well screen.

Another object is to provide well treating equipment such as that described wherein the means for short-circuiting the circulating flow path is a device having a lateral window in its wall and closure means controlling flow through the window, the closure initially closing the window against flow and being openable when the pressure exterior thereof exceeds that interior thereof by a predetermined amount.

A further object of this invention is to provide improved well treating apparatus such as that described wherein the means controlling the differential pressure at which the lateral window of the short-circuiting mechanism opens is adjustable.

Another object is to provide an improved service seal unit tool for setting a packer and screen in a well and then controlling the circulation of fluids therethrough, said service seal unit tool having a first flow controlling means operable responsive to longitudinal movement of the pipe string to which it is attached for controlling circulation of fluids in a pattern for depositing particulate material such as sand or gravel about the screen and having an initially closed lateral window for short-circuiting the flow path to make possible depositing such particulates to a depth well above the screen.

Another object is to provide such an improved method wherein the particulate material is packed to sufficient height above the packer while not requiring excessive longitudinal distance between the packer and the screen.

Another object is to provide such an improved service seal unit tool wherein the lateral window thereof is openable when the external pressure exceeds the internal pressure by a predetermined amount so that additional particulate material can be deposited above the screen and dehydrated to pack the particles in closer relationship with one another.

Another object is to provide such an improved tool wherein the means holding the lateral window thereof closed is adjustable to respond to various desired differential pressure values.

Another object of this invention is to provide an improved method of packing sand, gravel, or the like particulate material around a screen in a well for providing lateral support to the formation to hold it in place and for excluding formation sand from the well bore.

Another object is to provide an improved method of packing particulate material around a screen in a well using a conventional packer and well screen with an improved service seal unit tool wherein after the packer is set, the pipe string is lifted relative to the packer and fluids are circulated downward through the packer and its ports to the exterior of the screen, the fluids flow through the screen leaving the particulates deposited exterior thereof, the fluids then flow upward through the packer to the surface, and when the particulates build up sufficiently around the screen, pressure is increased inside the screen until a short-circulating device opens to permit further deposition of particulates even to a height well above the packer.

Another object is to provide such a method wherein after the particulate material is compacted around the screen and to sufficient height thereabove, the service seal unit tool is lifted relative to the packer and cleanout fluids are reverse-circulated therethrough to remove excess treating fluids and particulates from the well.

A further object is to add to such methods the removal of the service seal unit from the well and the installation of a production seal unit in its place to cause production fluids from the formation to enter the well bore through the perforations, be directed through the particulate pack and screen, and then flow upward through the pipe string to the surface.

Other objects and advantages will become apparent from reading the description which follows and from studying the accompanying drawing, wherein, FIGS. 1-A and 1-B, taken together, constitute a schematical view showing the lower portion of a well with the apparatus of this invention installed therein ready to perform the methods of this invention;

DESCRIPTION OF THE PREFERRED EMBODIMENT

Figure 1A:
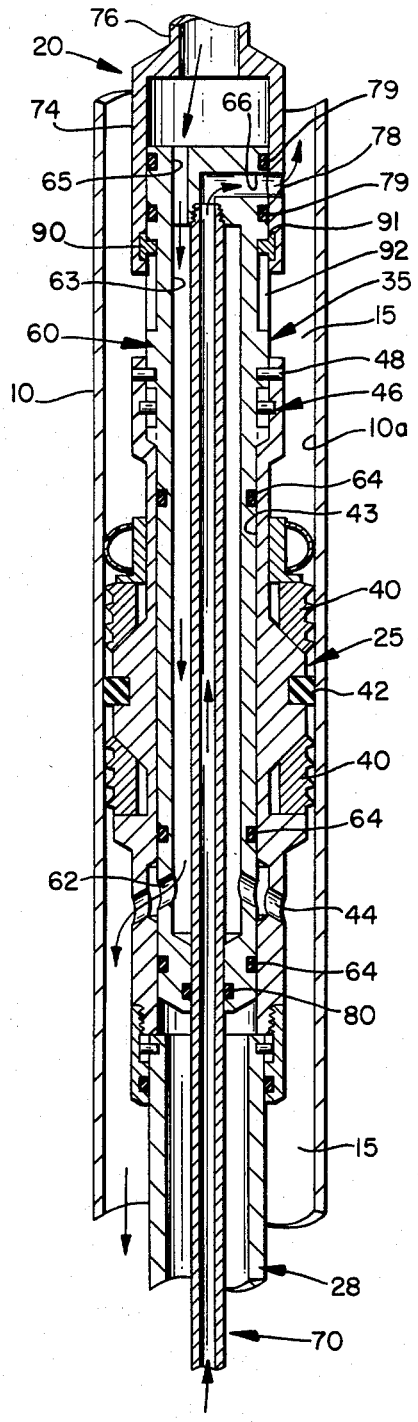
Figure 1B:
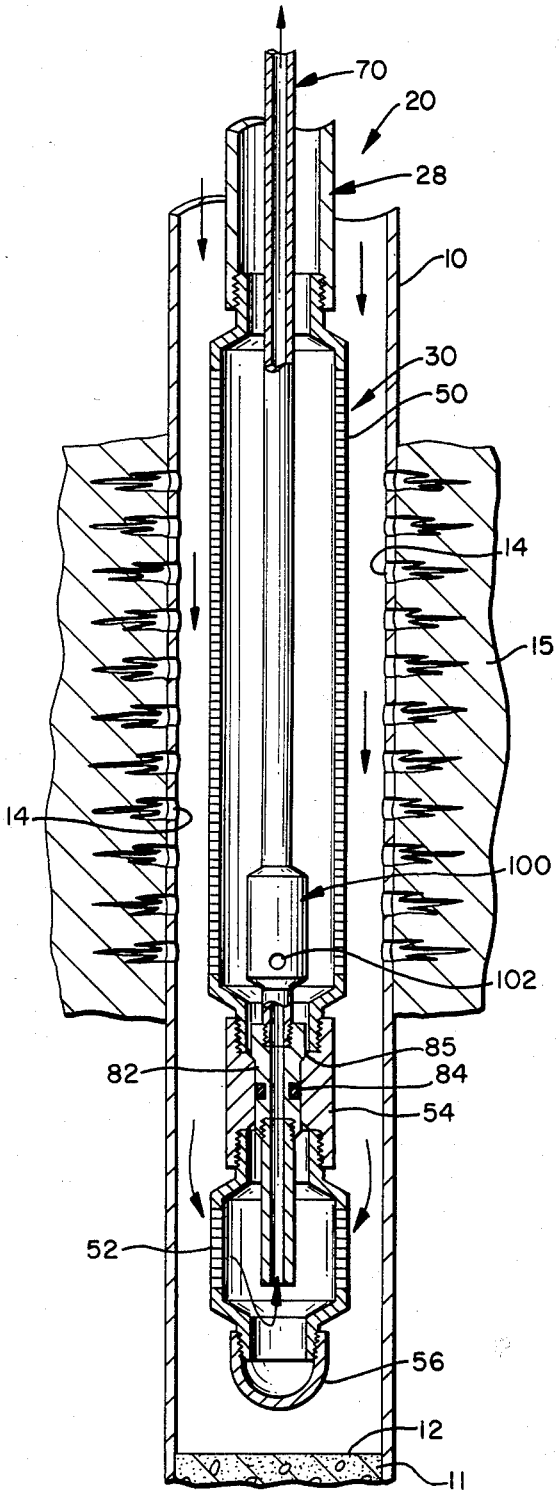
Figure 2:
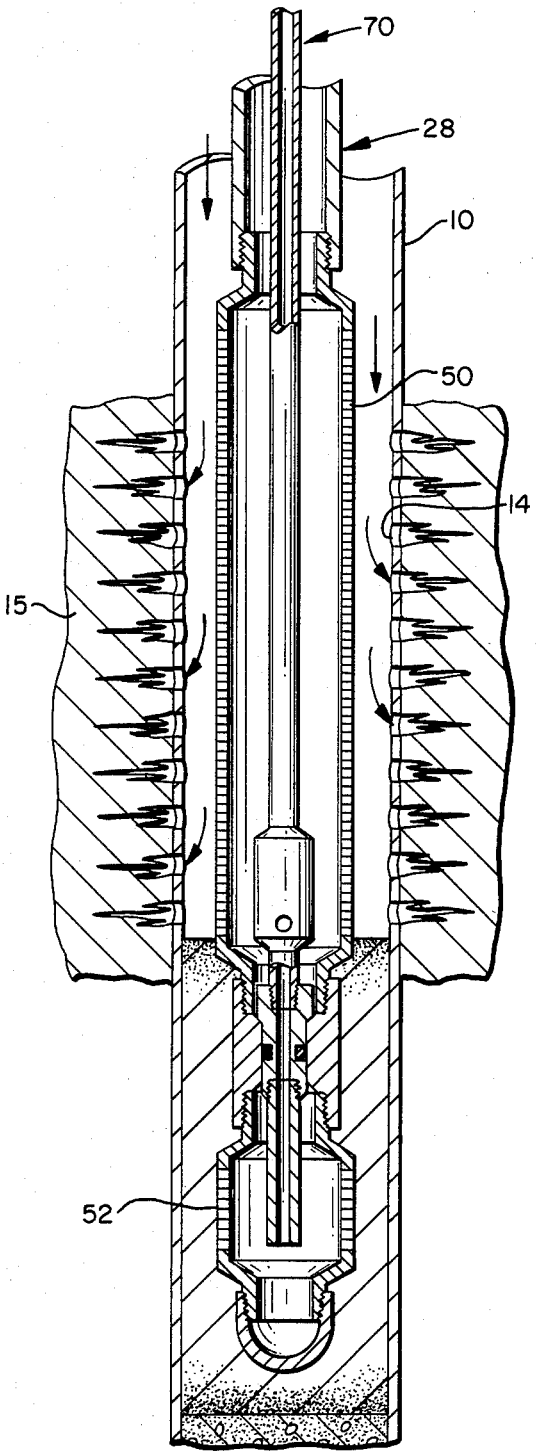
FIG. 2 is a fragmentary view, similar to FIG. 1-B, showing particulate material such as sand or the like being deposited in the well exterior of the screen and fluids being forced outwardly through the casing perforations.

Referring now to FIGS. 1-A and 1-B, it will be seen that the well casing 10 is plugged as at 11 to create a bottom 12 in the well. This plug may be cement, a bridge plug, or other suitable plugging means. The casing is perforated as at 14 opposite producing formation 15, and the apparatus 20 of this invention is shown to be installed in the casing preparatory to performing an operation soon to be described.

The apparatus 20 includes a well packer 25, a spacer pipe 28, a screen assembly 30, and a service seal unit 35.

The well packer 25 is shown to be set in the casing above the perforations 14. It is seen that the packer slips 40 are engaged with the inner wall 10*a* of the well casing to lock the packer in place and that the seal 42 of the packer seals between the packer and the casing. Near the lower end of the packet, lateral openings 44 are provided which communicate the bore 43 of the packer with the exterior thereof below the packer seal 42. These lateral openings 44 may be provided in the packer mandrel as shown or in a tubular member attached to the lower end of the packer mandrel. A spacer pipe 28 is attached below the packer as shown, and this spacer pipe may be of any desired length, but for operations such as that to be described, its length would seldom exceed approximately 20 feet. Suspended from the lower end of the spacer pipe 28 is the screen assembly 30.

The screen assembly 30 preferably consists of a main screen 50, and a tell-tale screen 52 connected to the lower end of the main screen by a connector member or nipple 54. The lower end of the tell-tale screen is plugged as by bull plug 56.

It is important when setting the packer that it be located with the main screen 50 opposite the perforations 14 and preferably with the lower portion of the screen approximately even with the lowermost perforation and the upper portion of the screen extending a short distance above the uppermost perforation. This latter distance is preferably approximately two feet. The lower end of the apparatus, that is the bull plug 56 on the bottom of the tell-tale screen, will be spaced above the well bottom 12 a short distance although this distance could be considerable.

The service seal unit tool 20 has an elongate tubular body 60 which is telescoped into the bore 43 of the packer and has lateral ports 62 near its lower end which, when the service seal unit tool 20 is installed in the packer, are approximately on the same level with the lateral openings 44 near the lower end of the packer, as clearly shown. A pair of seal rings 64 on the service seal unit tool body seal between the service seal unit tool and the packer above and below the ports 62 and 44 just mentioned. A third seal 64 is carried by the service seal unit tool and seals with the packer near the upper end thereof to prevent the settling of sand and debris between the service seal unit and the packer. The upper end of the elongate body 60 of the service seal unit tool has an offset passage 65 which communicates the bore 63 of the body with the region above the upper end of the body. The upper end of the body is also provided with an L-shaped cross-flow passage 66 having one leg opening outwardly through the side of the body and the other leg opening downwardly and threaded to receive a wash pipe 70, as shown.

Flow through the wash pipe 70 is controlled by means to be described.

A sleeve 74 attached to the pipe string 76, by which the apparatus is lowered into the well, surrounds the upper end of body 60 and is slidable longitudinally relative thereto. The sleeve 74 is provided with a lateral aperture 78 which is aligned with the passage 66 in the body 60 of the service seal unit tool, as is shown in FIG. 1-A, when the pipe string 76 is elevated relative to the packer 25, and the sleeve 74 is movable to a lower position wherein the port 78 thereof cannot communicate with the L-shaped passage 66 of the service seal unit body. The sleeve 74 is movable between the just described open and closed positions by moving the pipe string 76 vertically relative to the packer. Thus, when the pipe string is in its lower position, the L-shaped passage is closed, and when it is in its upper position, shown in FIG. 1-A, the L-shaped passage is open. A pair of seal rings 79 seal above and below the L-shaped passage 66 as shown.

The wash pipe 70 which may be formed of small diameter pipe, such as ¾-inch or 1-inch pipe, is threaded into the lower end of the vertical leg of the L-shaped passage 66 at the upper end of the service seal unit body, and this wash pipe extends downwardly through the lower end of the elongate body 60, and a seal 80 seals around the wash pipe as shown. The wash pipe also extends downwardly through the spacer pipe 28 and through the main screen 50 and connector member 54, and its lower end opens downwardly into the tell-tale screen 52 as shown. The wash pipe includes a seal sub 82 which carries a seal 84 for sealing between the seal sub and the nipple 54 and has an external downwardly facing shoulder 85 which engages the nipple 54 to locate the seal sub with respect thereto as shown. Located somewhere within the main screen 50 is a circulation control device 100 which is attached to or connected in the wash pipe 70. This circulation control device 100 is provided with a lateral window or passage 102 which is initially closed by suitable means yet to be described and is openable when the pressure exterior of the device 100 exceeds the pressure within the wash pipe by a predetermined amount.

The connection between the sleeve 74 connected to the pipe string and the upper end of the service seal unit tool is a slip-joint connection which allows the pipe string to be lifted and lowered a limited distance with respect to the packer. Preferably this slip-joint connection includes limit means providing both long and short strokes. Included are inwardly projecting lugs 90 which may be mounted on a ring 91 disposed in an internal annular recess so that the ring may rotate freely. The inwardly projecting portion of each lug is engaged in a control slot 92 formed in the outer surface of the service seal unit body 60. Thus, the sleeve can be lifted higher on alternate strokes and not so high on strokes in between. Thus, when the lugs are at the upper end of the long strokes, the L-shaped passageway 66 is open, as shown in FIG. 1-A, and when the lugs are at the upper end of the short strokes, the pipe can be placed in tension, but the sleeve 74 cannot be lifted sufficiently high to open the L-shaped passage 66 to the passage of fluids. This slip joint connection with the control slot, the valved L-shaped passageway, the packer and screen, the ports therebetween, the service seal unit and the wash pipe, except for the circulation control device 100, are old and are illustrated and described in U.S. Pat. No. 3,710,862 to Carter R. Young, et al, which has been incorporated herein by reference.

The service seal unit 20 is connected to the packer by suitable means such as a J-slot connection indicated by the numeral 46 and further may be secured by shear pins such as shear pins 48 as shown. If preferred, a straight slot rather than a J-slot may be utilized on the service seal unit body.

With the apparatus installed as shown in FIGS. 1-A and 1-B and with the pipe string 76 elevated to open the L-shaped passage 66 as shown, fluids may now be pumped as indicated by the arrows from the surface downward through the pipe string, through the small offset passage 65 at the upper end of the service seal unit tool, through the body 60 of the service seal unit tool, and outward through the aligned ports 62 and 44 of the service seal unit tool and the packer, into the well annulus 15 surrounding the apparatus, and down the annulus to the tell-tale screen 52. The fluids pass through the narrow openings or slits of the tell-tale screen to its interior, then upwardly through the wash pipe 70 to the L-shaped passageway 66 where the fluid is diverted outwardly into the well annulus 15 above the packer, then upwardly therethrough to the surface. This circulation path is used normally to displace well fluids present in the well and prepare it for the operation to follow. Upon completion of such displacement, the well will be completely full of liquid and ready to receive the slurry to be introduced into the pipe string 76 at the surface.

This slurry is made up of a fluid medium and a granular or particulate material. The particulate material may be sand, gravel, or the like. The fluid medium may be water or a water-based viscous liquid, generally a gelatinous material. The viscous gelatinous material, or gel, will better hold the particulate material in suspension and will better lubricate the material so that it would flow more easily, and the coating of the gelatinous material about the individual grains of the particulate material protects them from fragmentation due to colliding with one another as they are transported to their place of deposit in the well. Thus, there would be no tiny fragments of the grains to get wedged into or flow cut the narrow slits in the well screen.

The operation of the well treating apparatus 20 will be described herein performing a slurry pack operation with a high-density slurry composed of a gelatinous medium called a "gel" in which is suspended at least six pounds of sand per gallon of gelatinous medium. This slurry is mixed thoroughly before being introduced into the well.

Figure 3:
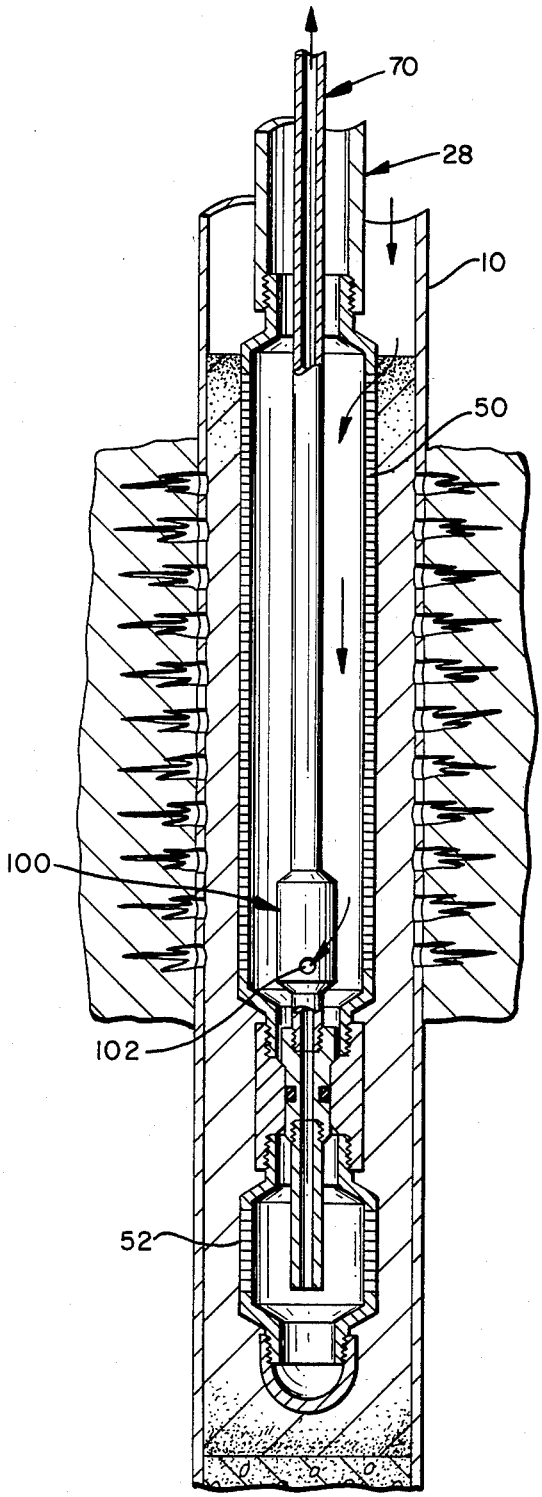
FIG. 3 is a fragmentary view, similar to FIG. 2, showing the particulate deposit built up to a height above the perforations and near the upper end of the screen, and showing the fluid circulation path short-circuited.

The sand slurry is introduced into the well at the surface and pumped down the well pipe to the apparatus 20 where it passes through the offset vertical passage 65 into the body of the service seal unit tool and passes outward through the ports 62 thereof and through the lateral openings 44 of the packer into the well annulus 15 below the packer. The slurry moves downward in the annulus and surrounds the screen assembly 30. Pressure applied to the slurry now causes the gel to flow through the slits in the tell-tale screen where the gel then enters the lower end of the wash pipe 70, flows upwardly to the L-shaped passage 66 at the upper end of the service seal unit tool, and exits through the aperture 78 in the sleeve 74, then moves upward in the annulus to the surface as indicated by the arrows. As the gel flows through the slits of the tell-tale screen 52, the sand grains are left in the well annulus exterior thereof, and these sand grains begin to collect on the bottom 12 of the well. As the level of the accumulated sand rises in the well annulus and begins to cover the slits of the tell-tale screen 52, resistance to flow of gel through the sand increases. When the level of the packed sand rises to a point near the lower end of the main screen or the lowest perforation, the resistance to flow reaches a point where the sand packed below the perforations is squeezed rather tightly causing the sand grains to move closer together and forcing the gel through the screen slits. Thus, the sand is "dehydrated" since the liquid medium has been squeezed out of it to considerable extent. The sand is no longer in suspension. Thus, the gel coating the sand grains is squeezed therefrom and is forced through the tell-tale screen until the pressure builds up to such high value that the medium begins to flow through the perforations 14 into the formation exterior of the casing. Now, as slurry is delivered to the area exterior of the main screen, gel is forced into the formation leaving sand packed in the perforations and in any cracks and crevices connected therewith, and the sand builds up in the annulus around the main screen. As this sand pack builds up, the resistance to flow increases, and by the time this pack is built up to a level just above the uppermost perforation and perhaps to a level about even with the upper end of the main screen 50, the pump pressure increases further. About the time that it becomes impossible to pump any more fluid into the formation, some fluid will pass through the slits in the upper portion of the screen and apply sufficient pressure therein surrounding the wash pipe to cause the lateral port 102 in the circulation control device 100 to open. Thus, gel begins to flow inwardly through port 102 and return to the surface as shown by the arrows. This is shown in FIG. 3.

Figure 4:
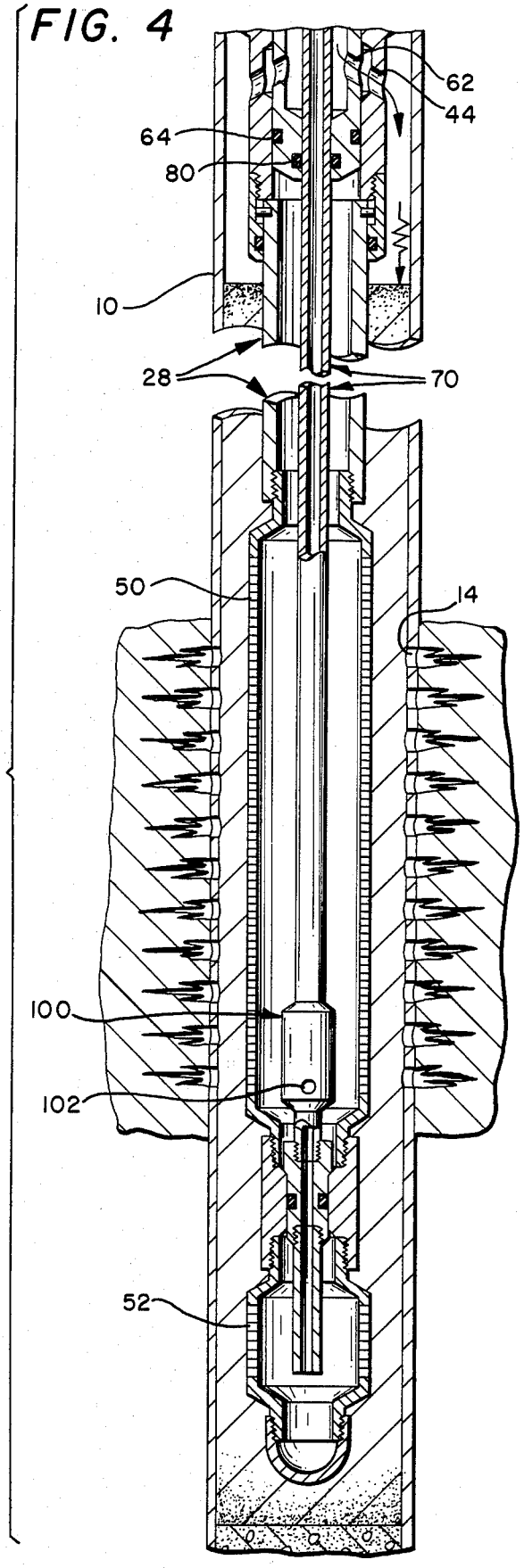
FIG. 4 is a fragmentary view, similar to FIGS. 1-A and 1-B, showing particulate material deposited to a level well above the screen.

The opening of port 102 in the circulation control device 100 permits circulation of fluids to continue. Additional slurry is delivered into the well annulus below the packer and additional fluid is forced into the upper part of the screen, then into the port 102 of the circulation control device to return to the surface through the wash pipe and the well annulus above the packer. Such additional slurry is delivered until the pack builds up so high that maximum predetermined pump pressure is reached and further slurry cannot be injected into the well. The top of the sand pack should now be at a level at or just below the lateral ports 44 of the packer as seen in FIG. 4.

Figure 5:
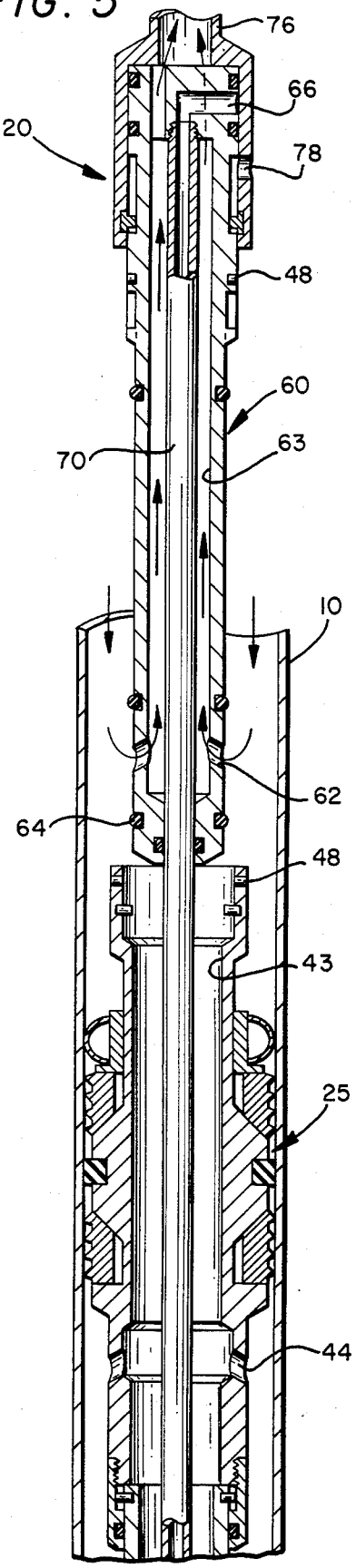
FIG. 5 is a fragmentary schematical view showing the service seal unit lifted partially from the packer and screen and cleanout fluids being circulated to remove excess treating fluids and particulates from the well.

After the sand pack has been completed as just described, the tubing is lowered to close the L-shaped passage 66 at the upper end of the service seal unit, and this lowering of the tubing causes the zig-zag control slot 92 and lugs 91 to operate as before explained so that when the pipe string is picked up again, the sleeve cannot be lifted sufficiently high to again open the L-shaped passage 66, so it remains closed. Further lifting of the pipe string will cause the shear pins 48 to fail, thus releasing the service seal unit from the packer. The service seal unit tool is then lifted sufficiently high to place the lower end of its body 60 just above the upper end of the packer, as seen in FIG. 5, so that cleanout fluids may now be freely circulated from the surface downward through the well annulus, through the lateral openings 62 near the lower end of the service seal unit tool body, then upward through the service seal unit tool body 60 and the pipe string 76 to the surface, as shown by the arrows. Circulating cleanout fluids in this manner will remove the excess slurry from the well.

Figure 6:
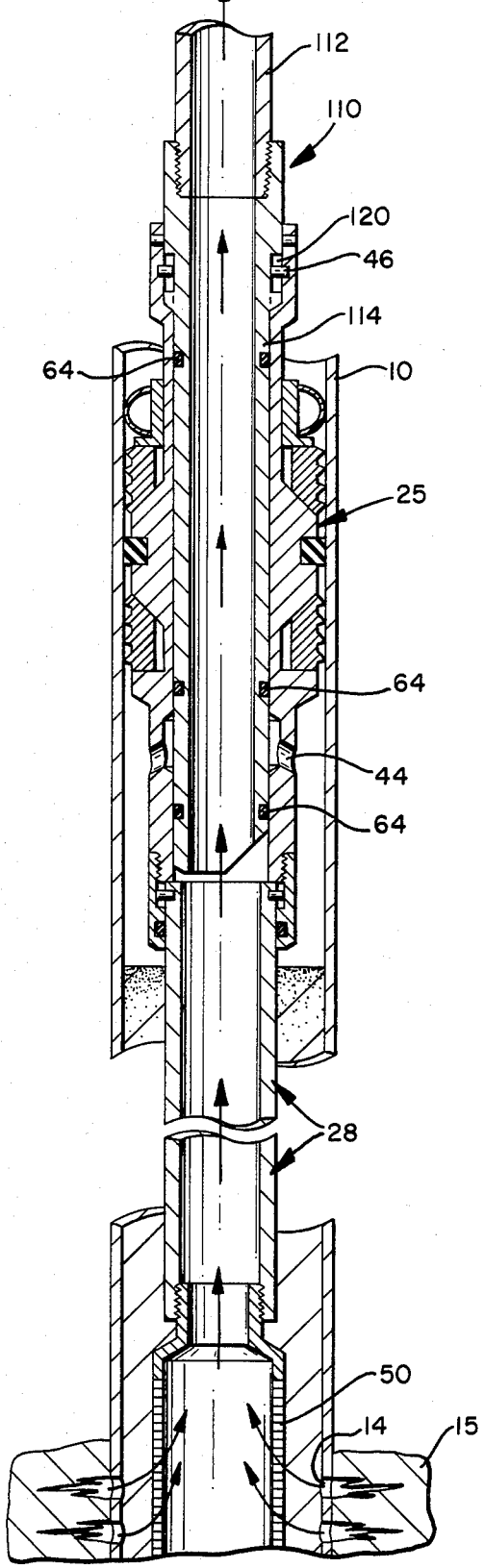
FIG. 6 is a fragmentary schematic view showing the well of FIGS. 1-A–4 prepared for production.

After the well has been cleansed of the excess slurry, the pipe string with the entire service seal unit tool including the entire wash pipe is retrieved from the well, after which the well is prepared for production, as is shown in FIG. 6.

To prepare the well for production, a production seal nipple 110 is attached to the lower end of a suitable pipe string such as the tubing 112 and is lowered into the well. The seal nipple is telescoped into the packer bore in the same manner as was the service seal unit tool 20, and its tubular body 114 extends downwardly therein to a short distance below the lateral openings 44. The service seal unit carries a pair of seals 64 which may be exactly like the seals 64 carried on the service seal unit tool, and these seals 4 sealingly engage the packer both above and below the lateral ports 44, thus closing off these ports. If desired, a third seal 64 may be provided on the seal unit to seal near the upper end of the packer as shown to prevent fouling by sand, debris, or the like.

Well fluids may now flow from the formation 15 and through the perforations 14 into the well bore, pass through the sand pack into the main screen 50, and flow upwardly through the spacer pipe 28, through the service seal unit tool body 114, and through the tubing to the surface. Of course, before production can be had, the well must be brought in in the usual manner. If desired, the production seal unit tool may be provided with a J-slot such as the J-slot 120 which will engage the J-pins or lugs 46 of the packer to anchor the lower end of the tubing string 112 to the packer.

It can now be seen that a method has been disclosed for the purpose of preparing a well for production. This method involves the steps of connecting the well packer 25 to the screen assembly 30 by attaching therebetween a spacer such as the spacer 28, there being provided lateral ports such as the lateral ports 44 below the packer and preferably in the lower portion of the packer. The screen and packer combination are then attached to a service seal unit tool such as service seal unit tool 20 so that the body of the service seal unit tool extends into the packer bore with the seals thereon sealing on either side of the lateral ports 44 of the packer while the lateral ports 62 of the service seal unit are aligned with the packer ports 44. The service seal unit tool is secured to the packer with releasable means such as the well-known J-slot and pin connection or with shear pins, or with both, and the service seal unit tool has its upper end connected to the lower end of a pipe string. The pipe string is lowered into the well, and the packer is set above the perforations, after which fluid such as treating fluid is forced down the pipe string and through the packer and the lateral ports thereof to the exterior of the screen. These treating fluids flow inwardly through the screen and then upwardly through the packer to the surface. A slurry of liquid medium and sand, gravel, or the like, is introduced into the well and forced down the pipe string and through the packer and its lateral ports to the exterior of the screen, and the liquid moves inwardly through the screen and then upwardly through the packer to the surface, leaving the sand deposited exterior of the screen. The sand is packed and built up in the region exterior of the screen until the circulation pressure reaches a certain high value, and then the fluid medium begins to flow into the formation, thus effecting the deposit of more sand in the region exterior of the screen and in the perforations. As the packing operation continues and the sand accumulates to a higher level in the well annulus, the resistance to flow therethrough becomes greater, and when the fluid pressure becomes sufficiently great, a side port in the wash pipe opens to short-circuit the flow path for the liquid, and this allows further pumping and further depositing of sand in the annulus until so much gets tightly packed there that the resistance to flow therethrough becomes so great that the maximum allowable pump pressure will not force any more liquid into the well. The next step is to lift the pipe string, disconnecting the service seal unit tool from the packer, lifting the pipe string further until the service seal unit body is withdrawn from the packer and then circulating cleanout fluids in reverse direction by forcing fluid down the annulus, through the side ports of the service seal unit body, then back up through the tool body and pipe string to the surface to clean the well of excess sand slurry. Further steps in the process call for removing the service seal unit from the well, replacing the service seal unit with a production seal unit, and lowering the pipe string or a tubing string back into the well, installing the production seal unit in the packer, and then producing the well through the tubing string to the surface.

Figure 7:
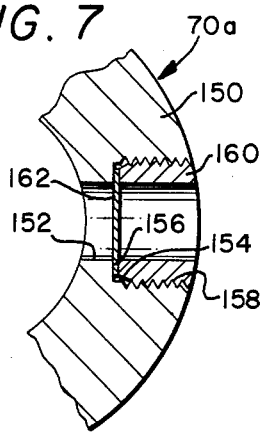
FIG. 7 is a fragmentary view showing in transverse section a simple rupture disc secured in the lateral port of a circulation control device to initially hold the port closed.

It is to be noted that the circulation port such as circulation port 102 in the circulation device 100 is openable in response to the pressure exterior of the wash pipe exceeding that within the wash pipe by a predetermined value and is not responsive to movement of the pipe string; therefore, the pipe string can remain as shown in FIGS. 1-A-4 for this operation. The port 102 will be opened automatically when the predetermined differential pressure is reached. The means holding the circulation port 102 closed is preferably adjustable to provide opening at the desired differential pressure. There may be several ways of forming such a device. A common back pressure valve such as a spring loaded ball and seat or a gas lift valve would open at a predetermined pressure differential; however, such differential would need to be maintained in order to maintain the valve open. This would require excessive pressure and energy. Preferably, the port 102 should remain closed until the required differential pressure is reached at which time it would open and remain open for the remainder of the operation. This can be accomplished by providing a rupture disc in the lateral passage or port of the wash pipe as seen in FIG. 7. In FIG. 7, a portion of the wash pipe 70*a* has a thick wall section such as indicated by the numeral 150, and this section is provided with a lateral opening 152 which is enlarged as at 154 to provide a shoulder 156. The enlarged bore is threaded as at 158, and a nut 160 is tightened against a rupture disc 162 as shown to seal the passage 152. The rupture disc 162 is selected as to its thickness and material strength so that it will rupture when the pressure exterior of the wash pipe exceeds the pressure within the wash pipe by a predetermined amount. It will remain open after rupture.

Since rupture discs are perhaps not as predictable as shear pins, a more sophisticated circulation control device utilizing shear pins may be provided. Such a device is seen in FIG. 8.

Figure 8:
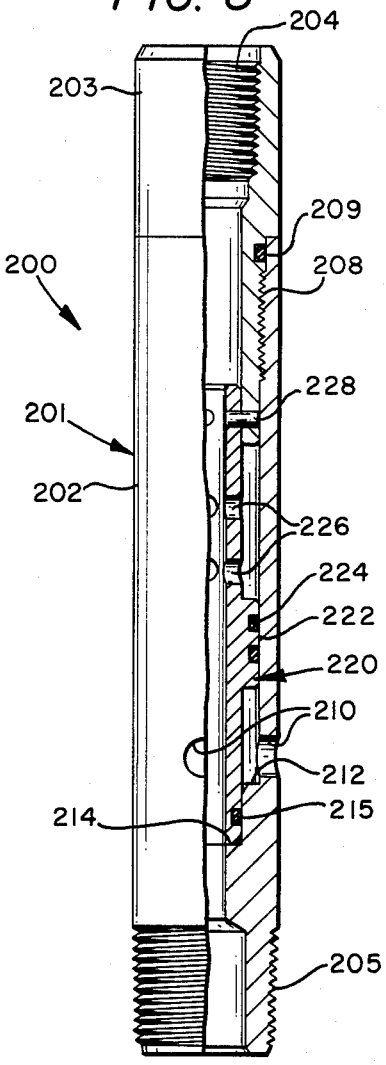
FIG. 8 is a view in longitudinal section showing one form of valve which is usable in the apparatus of this invention for short-circuiting the flow circulation pattern as shown in FIG. 3.

In FIG. 8, the circulation control device 200 includes a housing 201 comprising a barrel 202 and an upper sub 203. The upper sub is threaded as at 204, and the barrel is threaded as at 205 for connection into the wash pipe. The barrel is threadedly connected on the upper sub as at 208, and this connection is made fluid tight by a seal ring 209 as shown. The barrel is provided with at least one or preferably with a plurality of lateral flow ports 210, and just below these ports the bore of the barrel is reduced to provide a shoulder as at 212 and again as at 214.

A tubular closure member 220 is disposed within the housing and has its lower end abutting the upwardly facing shoulder 214 therein. Seal ring 215 seals about the lower end of closure member 220. The closure member has an external annular flange or piston 222 spaced above the lateral flow ports 210, and this flange is provided with at least one seal ring 224 which sealingly engages the inner wall of the barrel as shown. Thus, fluids entering the barrel from the exterior through the ports 210 are sealed off by the seal rings 215 and 224.

Above the piston 222, the closure member is provided with at least one and preferably with a plurality of ports 226 through its wall as shown. One or a plurality of shear pins 228 of selected diameter are disposed in aligned apertures near the upper end of the closure member 220 and near the lower end of the top sub 203 when the closure member is disposed with its lower end in contact with the upwardly facing shoulder 214, that is, with the closure member in closed position. Pressure within the wash pipe is transmitted outwardly through the apertures 226 and acts downwardly against the piston 222 but cannot move the closure member downwardly even though the pressure within the wash pipe may exceed that exterior thereof because the closure member 220 is supported against downward movement by shoulder 214. Thus, the pins 228 will not be damaged or sheared. When, however, the pressure exterior of the circulation control device exceeds the pressure within the wash pipe by a predetermined amount, and the upward force on the closure member due to the differential pressure acting across the piston will shear the pins 228 and will move the closure member upwardly so that its lower end rises above the shoulder 212, thus permitting flow to take place from the exterior to the interior through the now open lateral flow ports 210. Thus, when the differential pressure, that is, the difference between the pressures outside and inside of the wash pipe, reaches a predeteremined amount, the pin or pins 228 will be sheared, and the valve will open and stay open.

The circulation control device 200 will of course be retrieved from the well with the service seal unit tool and wash pipe, and this device may be redressed by unscrewing the top sub 203 from the barrel 202 and removing the closure member. After the parts are cleaned and the seals replaced, new shear pins 228 are installed. These pins are not only of selected diameter but are also of a selected material and a selected quantity to provide the desired shear value. The upper sub then is made up in the upper end of the barrel and tightened. The circulation control device is again ready to be made up in the wash pipe.

Equipment for performing operations and practicing methods such as those illustrated and described hereinabove is readily available. Suitable packers and service seal unit tools, as well as circulation control devices, are available from Otis Engineering Corporation, Dallas, Tex., and suitable well screens, both main screens and tell-tale screens, are available from Howard Smith Screen Company, Houston, Tex., or from Otis Engineering Corporation, Dallas, Tex.

Thus, it has been shown that an improved gravel pack apparatus and improved methods have been disclosed while performing slurry pack type operations in a well; that the apparatus and the methods disclosed fulfill all of the objects set forth hereinabove; that a packer and screen can be attached together with lateral ports therebetween and then attached to a service seal unit tool which is then attached to the lower end of a pipe string; that the pipe string may be lowered into the well and the packer set above the casing perforations so that the screen will be opposite the casing perforations; that a sand slurry can be circulated through the apparatus so that the sand will be deposited exterior of the screen and when the deposite of sand builds up it will be dehydrated, and when the resistance to flow therethrough reaches a certain point, fluids will be forced into the formation and sand will be packed into the perforations and other cracks and crevices which may be connected thereto, that when the sand pack builds up to a level near the upper perforations and the resistance to flow becomes great and it becomes virtually impossible to pump any more fluid into the formation, the circulation control device will open to permit freer circulation and the deposition of additional sand until the deposit builds up to a level somewhat above the upper perforations and above the upper end of the screen; and that when the sand is packed so high that available pump pressure will not pump any more fluid into the well, the service seal unit tool is lifted and reverse circulation is utilized to clear the well of excess slurry. After the sand pack has thus been completed, the service seal unit is removed from the well and is replaced by a production seal unit which may anchor the lower end of the tubing to the packer and also packs across the lateral ports of the packer so that production entering the well through the perforations cannot pass through these lateral ports but must pass through the screen and from there flow upwardly through the packer and the pipe string or tubing string to the surface.

The foregoing description and drawings have been herein presented by way of explanation only, and changes in materials, arrangement of equipment elements and sizes thereof, as well as variations in the methods and material, may be had within the scope of the appended claims without departing from the true spirit of this invention.

I claim:

1. Apparatus for treating a well, comprising:
   a. well packer means;
   b. well screen means connected below said packer means;
   c. means providing lateral flow port means between said packer means and said screen means; and
   d. service seal unit tool means attached to said packer and attachable to a pipe string, said service seal unit tool means including:
      i. tubular body means telescopically engaged in said packer means,
      ii. means on said tubular body means sealing both above and below said lateral port means, iii. tubular wash pipe means extending through said tubular body means and said packer and having its upper end opening outwardly into the well annulus above the packer while its lower end opens into said screen means, said wash pipe having a lateral circulation port in its wall communicating with the interior of the screen means, iv. means sealing between the screen means and the wash pipe below said lateral circulation port, and v. means initially closing said lateral circulation port said means being movable to port-open position automatically when the pressure exterior of the wash pipe exceeds the pressure interior thereof by a predetermined amount.

2. The apparatus of claim 1, wherein said service seal unit means includes means for controlling fluid flow between the upper end of said wash pipe and said well annulus, said flow controlling means being operable by longitudinal movement of said pipe string relative to the packer.

3. The apparatus of claim 2 wherein said lateral circulation port and said means initially holding said lateral circulation port closed include:

a. a tubular housing connectable in said wash pipe and having a lateral port in its wall and internal annular seat means spaced from said port;

b. a tubular valve closure member for controlling flow through said lateral port slidable in said housing between a port-closed position of engagement with said annular seat means and a port-open position wherein it is spaced from said annular seat means to allow flow through said port;

c. external annular piston means on said valve closure member having means thereon in sealing engagement with the inner wall of said housing on the opposite side of said lateral port from said annular seat means, the area sealed by said piston seal exceeding the area of said seat means whereby pressure exterior said circulation valve and transmitted through said lateral port acts on said piston tending to move said valve closure member from port-closed to port-open position; and d. means releasably holding said valve closure member in port-closed position in said housing, said releasable means being releasable when the pressure exterior of said wash pipe exceeds the pressure interior thereof by a predetermined amount.

4. The apparatus of claim 3 wherein said releasably holding means is one or more shear pins engaged between said valve closure member and said housing.

5. The apparatus of claim 4 wherein the release value of the shear pins is adjustable by providing one or more shear pins of a selected size and formed of a selected material of known shear strength.

6. A service seal unit tool for setting a packer and screen means in place in a well and establishing circuits for circulating fluids therethrough for treating the well therebelow with treating media and removing excess treating media from the well, including:

a. means for connecting the service seal unit tool to a pipe string and to the packer for setting the packer in the well, there being provided lateral flow port means between the packer and the screen means;

b. means for sealing between the service seal unit tool and the packer both above and below said lateral flow ports when said tool is installed in the packer;

c. means including a wash pipe for completing a fluid flow circuit for circulating fluids from the surface downward through the packer and lateral flow port means to the exterior of the screen means, thence through the screen means, and upward through the packer to the surface; and d. initially closed circulation control means forming a portion of said fluid flow circuit and having a lateral circulation port in its wall communicating with the interior of said screen means, said circulation control means being openable automatically when the pressure exterior of the circulation control means exceeds the pressure interior thereof by a predetermined amount.

7. The service seal unit tool of claim 6 wherein said circulation valve means includes:

a. a tubular housing connected in said wash pipe and having a lateral opening through its wall and an internal annular seat spaced from said lateral opening;

b. valve closure means in said housing engageable with said seat and movable longitudinally between valve-closed and valve-open positions; and c. means releasably initially securing said valve closure means in valve-closed position, said securing means being releasable automatically when the pressure exterior of the circulation valve exceeds that interior thereof by a predetermined amount.

8. The service seal unit tool of claim 7, including means for controlling fluid flow between the upper end of the wash pipe and the well annulus operable in response to longitudinal movement of the pipe string relative to said packer.

9. The service tool of claim 8, wherein said releasable securing means is adjustable to release at a predetermined load.

10. The service tool of claim 9, wherein the releasable securing means is one or more shear pins engaged between said valve closure means and said tubular housing, said shear pins being of a selected size, selected material, and selected quantity to provide the desired shear value.

11. The method of treating a well penetrating an earth formation and having a well casing installed therein and perforated opposite the earth formation, comprising the steps of:

a. attaching a well screen assembly to the lower end of a well packer and providing lateral port means between said screen assembly and said packer;

b. attaching the well packer and screen assembly to a service seal unit tool having a tubular body with lateral port means thereon and seal means on either side of said port means sealing above and below said lateral port means of said packer, and a wash pipe having its upper end opening through the side of the service seal unit tool and into the well annulus above the packer and its lower end opening into the lower potion of said screen assembly, means near the lower end of said wash pipe sealingly engaging said screen assembly, said wash pipe having a circulation port communicating with the bore of said screen assembly above the point of sealing engagement of the wash pipe with the screen assembly, and means initially closing said circulation port, said closing means being openable automatically when the pressure exterior of the wash pipe at the circulating port exceeds the pressure interior of the wash pipe by a predetermined amount;

c. attaching said service seal unit tool to a pipe string and lowering the pipe string, packer and screen assembly into the well;

d. setting the well packer above said casing perforations;

e. circulating a fluid containing sand or the like from the surface downward through the packer and lateral port means to the exterior of the screen assembly, thence through the screen assembly, and upward through the packer to the surface to deposit sand or the like in the casing exterior of the screen assembly;

f. increasing pressure in the screen assembly exterior of said wash pipe to a value sufficient to cause said circulation port to open, and circulating additional fluid to deposit additional sand or the like to tightly pack the same in the casing to a level approaching the lateral port means between said screen assembly and said packer;

g. lifting said service seal unit tool relative to said packer to place the seals thereon above said packer, and reverse circulating cleanout fluid downward through said well annulus, said lateral port means and upward through said pipe string to the surface to remove the excess slurry from the well.

12. The method of claim 11, including the additional steps of:

a. removing the service seal unit tool from the well;

b. attaching a tubular production seal unit to said pipe string, said production seal unit having a pair of seals;

c. lowering said pipe string into said wall and installing said production seal unit in said packer so that the pair of seals on the production seal unit seal above and below said lateral port means whereby production fluids may enter the well through the perforations, flow through the deposit of sand or the like and through the screen, thence upward through the production seal unit and the pipe string to the surface.

13. The method of treating a well penetrating an earth formation and having a well casing installed therein and perforated opposite the earth formation, comprising the steps of:

a. lowering into the well a pipe string on which is suspended well treating apparatus including a well packer and screen assembly connected together with means providing lateral opening means therebetween, and a service seal unit tool connected between the packer and the pipe string and having a tubular body telescoped into said packer and having seal means thereon sealing above and below said lateral opening means, said body having lateral port means communicating with said lateral opening means, said treating apparatus further including a wash pipe extending through said packer and having its lower end opening into the lower portion of said screen assembly with annular seal means sealing about its lower end portion and circulation valve means in said wash pipe above said annular seal and being responsive to an elevated pressure exterior thereof, the upper end of said wash pipe opening into the well annulus above the packer, said service seal unit tool being connected to said pipe string with a lost motion connection in the form of a sliding crossover valve for opening and closing the upper end of said wash pipe in response to longitudinal movement of the pipe string relative to the packer;

b. setting the packer above the casing perforations;

c. lifting the pipe string relative to the packer to open the sliding valve at the upper end of the wash pipe to establish a fluid flow circuit for circulating fluids downward through said packer and said lateral openings to the exterior of the screen assembly, through the screen, and upward through the wash pipe and packer to the surface;

d. pumping treating fluids through said fluid flow circuit in the well;

e. opening said circulation valve to short-circuit said fluid flow circuit by increasing the pressure exterior said circulating valve to a value which exceeds that of the pressure interior thereof by a predetermined amount;

f. lowering said pipe string relative to said packer to close said crossover valve at the upper end of the wash pipe;

g. lifting the well pipe relative to the packer, releasing the service seal unit tool from the packer and disengaging the seals from their engagement in the packer;

h. circulating cleanout fluid down the well annulus to the service seal unit tool, inward through the lateral ports thereof, and upward through the pipe string to the surface.

14. The method of claim 13 wherein said sliding valve for controlling flow through said wash pipe is provided with means for latching the valve in closed position after it has been moved from its open to its closed position.

15. The method of claim 14 wherein said connection between said service seal unit tool and said packer is a frangible connection releasable responsive to a predetermined tensile load.

16. The method of claim 15 wherein the treating fluid contains sand or the like.

17. The method of claim 13 wherein said screen assembly includes a main well screen and a tell-tale screen connected therebelow with means therebetween providing a receptacle in which the lower end portion of said wash pipe is sealingly engaged.

18. The method of claim 17 wherein said circulating valve is provided with side port means, valve means controlling flow therethrough, and means releasably securing said valve means in closed position, said securing means being releasable responsive to the pressure exterior of the circulating valve reaching a magnitude which exceeds the magnitude of the pressure interior thereof by a predetermined amount.

19. A method of treating a well penetrating an earth formation and having a well casing installed therein and perforated opposite the earth formation, comprising the steps of:

a. lowering into the well a pipe string on the lower end of which is connected well treating apparatus comprising a well packer and screen assembly connected together by means providing lateral opening means therebetween, and a service seal unit tool connected by releasable means to the upper end of said packer and having a tubular body telescoped into said packer with means sealing above and below said lateral opening means, said tool having lateral port means in communication with said lateral opening means, said tool having a wash pipe extending through said body and packer and having its lower end opening into the lower portion of said screen assembly with means sealing about the lower portion of said wash pipe, the wash pipe including an initially closed circulating valve above the seal about its lower end portion openable when the pressure exterior of the valve exceeds that interior thereof by a predetermined amount, the upper end of said wash pipe opening into the well annulus above the packer, there being crossover valve means for controlling flow through the wash pipe, said valve means being operable between open and closed positions by lifting and lowering of the pipe string relative to the packer;

b. setting the packer above the casing perforations;

c. lifting the pipe string to open the crossover valve means;

d. pumping treating fluid containing sand or the like downward through the pipe string, packer, and lateral opening means to the exterior of said screen assembly, through said screen, and upward through said wash pipe and well annulus to the surface and causing the sand or the like to be deposited about the screen assembly;

e. pumping additional treating fluid containing sand or the like into the well pipe and increasing the deposit of sand or the like about the screen assembly and increasing pressure exterior said circulating valve sufficient to cause opening of the same;

f. pumping additional treating fluid containing sand or the like to the exterior of the screen assembly, through the screen assembly and circulating valve, then upwardly through the wash pipe and well annulus to the surface and continue pumping until the pressure in the well increases to a predetermined magnitude substantially higher than the pressure at which the circulating valve opened;

g. lower the pipe string to close the crossover valve;

h. lift the pipe string and service seal unit to release from the packer and continue lifting until the tool seals are disengaged from the packer;

i. circulate cleanout fluids downward through the well annulus, inward through the lateral port means of the service seal unit tool, and upward through the pipe string to the surface to remove excess treating fluid and/or sand or the like from the well.

20. The method of claim 19 including the additional steps of:

a. withdrawing the pipe string and service seal unit tool from the well;

b. attaching to the lower end of the pipe string a production seal unit having a pair of seals thereon; and c. lowering the pipe string and production seal unit into the well and installing the production seal unit in the packer with the pair of seals thereof sealingly engaged in the packer above and below the lateral opening means therein.

21. The method of claim 19 wherein said screen assembly includes a main well screen and a tell-tale screen connected together by means providing a receptacle in which the lower end portion of said wash pipe is sealingly engaged.

22. The method of claim 20 including the additional steps of:

a. withdrawing the pipe string and service seal unit tool from the well;

b. attaching to the lower end of the pipe string a production seal unit having a pair of seals thereon; and c. lowering the pipe string and production seal unit into the well and installing the production seal unit in the packer with the pair of seals thereof sealingly engaged in the packer above and below the lateral opening means therein.

* * * * *